US007145287B2

(12) United States Patent
Kato

(10) Patent No.: US 7,145,287 B2
(45) Date of Patent: Dec. 5, 2006

(54) SPARK PLUG HAVING NOBLE METAL TIP

(75) Inventor: Tomoaki Kato, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 11 days.

(21) Appl. No.: 10/949,398

(22) Filed: Sep. 27, 2004

(65) Prior Publication Data

US 2005/0067933 A1 Mar. 31, 2005

(30) Foreign Application Priority Data

Sep. 27, 2003 (JP) ..... 2003-373435

(51) Int. Cl.
*H01T 13/20* (2006.01)

(52) U.S. Cl. ..... 313/141; 313/118

(58) Field of Classification Search ..... 313/141, 313/118

See application file for complete search history.

(56) References Cited

U.S. PATENT DOCUMENTS 6,653,767 B1 11/2003 Morita et al.
6,720,716 B1 4/2004 Shibata et al.
6,750,598 B1 6/2004 Hori
2002/0038992 A1 4/2002 Morita et al.
2002/0067111 A1 6/2002 Shibata et al.
2002/0070646 A1* 6/2002 Chiu ..... 313/141
2003/0155849 A1 8/2003 Hori
2003/0193282 A1 10/2003 Shibata et al.
2004/0041506 A1 3/2004 Teramura et al.
2004/0061421 A1 4/2004 Morita et al.

FOREIGN PATENT DOCUMENTS

JP 2002-184551 A 6/2002
JP 2002-324650 A 11/2002
JP 2003-317896 A 11/2003
JP 2004-6250 A 1/2004
JP 2004-127916 A 4/2004

* cited by examiner

*Primary Examiner*—Joseph Williams
*Assistant Examiner*—Bumsuk Won
(74) *Attorney, Agent, or Firm*—Sughrue Mion, PLLC

(57) ABSTRACT

A spark plug which satisfies $\phi B \leqq 0.8$ mm, $\phi B/\phi A \geqq 1.4$, and 0.5 mm$\leqq C \leqq$1.2 mm, where $\phi A$ (mm) is the diameter of a distal end portion (51) formed of a noble metal tip (51*b*) of a center electrode 3; $\phi B$ (mm) is the diameter of a discharge portion (52) formed of a noble metal tip (52*b*) of a ground electrode (4); and C (mm) is a projection length of the discharge portion (52) from an electrode base metal surface (4*a*).

7 Claims, 6 Drawing Sheets

SPARK PLUG HAVING NOBLE METAL TIP

BACKGROUND OF THE INVENTION

1. Field of the Invention

The present invention relates to a spark plug.

2. Description of the Related Art

Japanese Patent Application Laid-Open (kokai) No. 2002-319469 discloses a spark plug in which noble metal tips, containing a predominant amount of a noble metal, are joined respectively to a center electrode and a ground electrode; the noble metal tips have an outside diameter of 0.8 mm or less; and the length of projection of the noble metal tip from the base metal of the ground electrode is 0.3 mm to 1.5 mm. Japanese Patent Application Laid-Open (kokai) No. 2002-184551 discloses a spark plug in which noble metal tips, containing a predominant amount of a noble metal, are joined respectively to a center electrode and a ground electrode; the noble metal tips have an outside diameter of 0.8 mm or less; and the length of projection of the noble metal tip from the base metal of the ground electrode is 0.5 mm to 1.2 mm.

3. Problems to be Solved by the Invention

In the above-disclosed spark plugs, when a portion of the noble metal tip of the ground electrode that projects from the electrode base metal is reduced in diameter in order to enhance ignition performance, the noble metal tip of the ground electrode is consumed to a greater than the noble metal tip of the center electrode. This is because the temperature increase of the noble metal tip of the ground electrode tends to be greater than that of the center electrode. As a result, the noble metal tip of the ground electrode tends to lack durability as compared with the noble metal tip of the center electrode.

SUMMARY OF THE INVENTION

The present invention has been accomplished in view of the above problems of the prior art, and an object of the present invention is to provide a spark plug in which the durability of the noble metal tip of the ground electrode can be enhanced while maintaining high ignition performance.

The above object has been achieved, in a first aspect of the invention, by providing a spark plug which comprises a center electrode 3; an insulator 2 surrounding the center electrode 3 such that a distal end portion 51 disposed on the center electrode 3 projects from the insulator 2; a metallic shell 1 holding the insulator 2; and a ground electrode 4 fixed to the metallic shell 1 and having a discharge portion 52 projecting from an electrode base metal surface 4*a* of the ground electrode 4, and a discharge gap 6 being formed between a distal end surface 52*a* of the discharge portion 52 and a distal end surface 51*a* of the distal end portion 51 of the center electrode 3. The spark plug satisfies $$\phi B \leqq 0.8 \text{ mm},$$

$$\phi B/\phi A \geqq 1.4, \text{ and}$$

$$0.5 \text{ mm} \leqq C \leqq 1.2 \text{ mm},$$

where ϕA (mm) is the diameter of the distal end portion 51 formed of a noble metal tip 51*b*, which contains a predominant amount of a noble metal; ϕB (mm) is the diameter of the discharge portion 52 formed of a noble metal tip 52*b*, which contains a predominant amount of a noble metal; and C (mm) is a projection length of the discharge portion 52 from the electrode base metal surface 4*a*.

The ground electrode tip assumes a diameter greater than that of the center electrode tip, whereby balance is attained between consumption of the center electrode and consumption of the ground electrode. The consumption of the electrode tips as used herein means a reduction of each tip length in the spark discharge direction, to thereby expand the spark gap therebetween. Thus, high ignition performance and durability of the spark plug can be improved based on balanced consumption of the both electrodes.

The above object has also been achieved in a second aspect of the invention, by providing a spark plug which comprises a center electrode 3; an insulator 2 surrounding the center electrode 3 such that a distal end portion 51 disposed on the center electrode 3 projects from the insulator 2; a metallic shell 1 holding the insulator 2; and a ground electrode 4 fixed to the metallic shell 1 and having a discharge portion 52 projecting from an electrode base metal surface 4*a* of the ground electrode 4, and a discharge gap 6 being formed between a distal end surface 52*a* of the discharge portion 52 and a distal end surface 51*a* of the distal end portion 51 of the center electrode 3. The spark plug satisfies $$\phi B \leqq 0.8 \text{ mm},$$

$$\phi B/\phi A \geqq 1.2, \text{ and}$$

$$0.5 \text{ mm} \leqq C \leqq 1.2 \text{ mm},$$

where ϕA (mm) is the diameter of the distal end portion 51 formed of a noble metal tip 51*b*, which contains a predominant amount of a noble metal; ϕB (mm) is the diameter of the discharge portion 52 formed of a noble metal tip 52*b*, which contains a predominant amount of a noble metal and having a survival rate of 90% or higher as measured after being subjected for 100 hours in an air atmosphere to a temperature of 1,000° C. in an electric furnace; and C (mm) is a projection length of the discharge portion 52 from the electrode base metal surface 4*a*.

Generally, the temperature of the discharge portion of the ground electrode becomes 100° C. to 200° C. higher than that of the distal end of the center electrode. By forming the noble metal tip of the ground electrode from a noble metal material whose high-temperature oxidation resistance is higher than that of the noble metal tip of the center electrode, the consumption of the noble metal tip of the ground electrode can be reduced. The high temperature oxidation resistance as used herein means resistance to oxidation of a metal at high temperature. Even though the ratio of the diameter of the ground electrode tip to the diameter of the center electrode tip is smaller than in the case of the first aspect of the invention, the center electrode tip and the ground electrode tip are consumed in a balanced (roughly equal) manner. Thus, higher ignition performance can be maintained. The noble metal tip 52*b* forming the discharge portion 52 becomes advantageous when the metal tip 52*b* made of one selected from the following three alloys is used: (1) a platinum alloy containing 20% by mass (or rather by weight) or less of iridium and 10% by mass or less of nickel, in which a total amount of iridium and nickel does not exceed 20% by mass; (2) a platinum alloy containing rhodium and 10% by mass or less of nickel; or (3) an alloy containing platinum, iridium, rhodium and 10% by mass or less of nickel, in which a weight ratio of rhodium to iridium is 20% or more.

By embedding, in the electrode base metal 4*b* of the ground electrode, a material 4*c* having a thermal conductivity higher than that of the electrode base metal, the temperature of the ground electrode can be lowered. Thus, the consumption of the noble metal tip of the ground electrode can be further reduced, whereby the effect of the present invention can be maintained for a longer time and with greater reliability.

Figure 1:
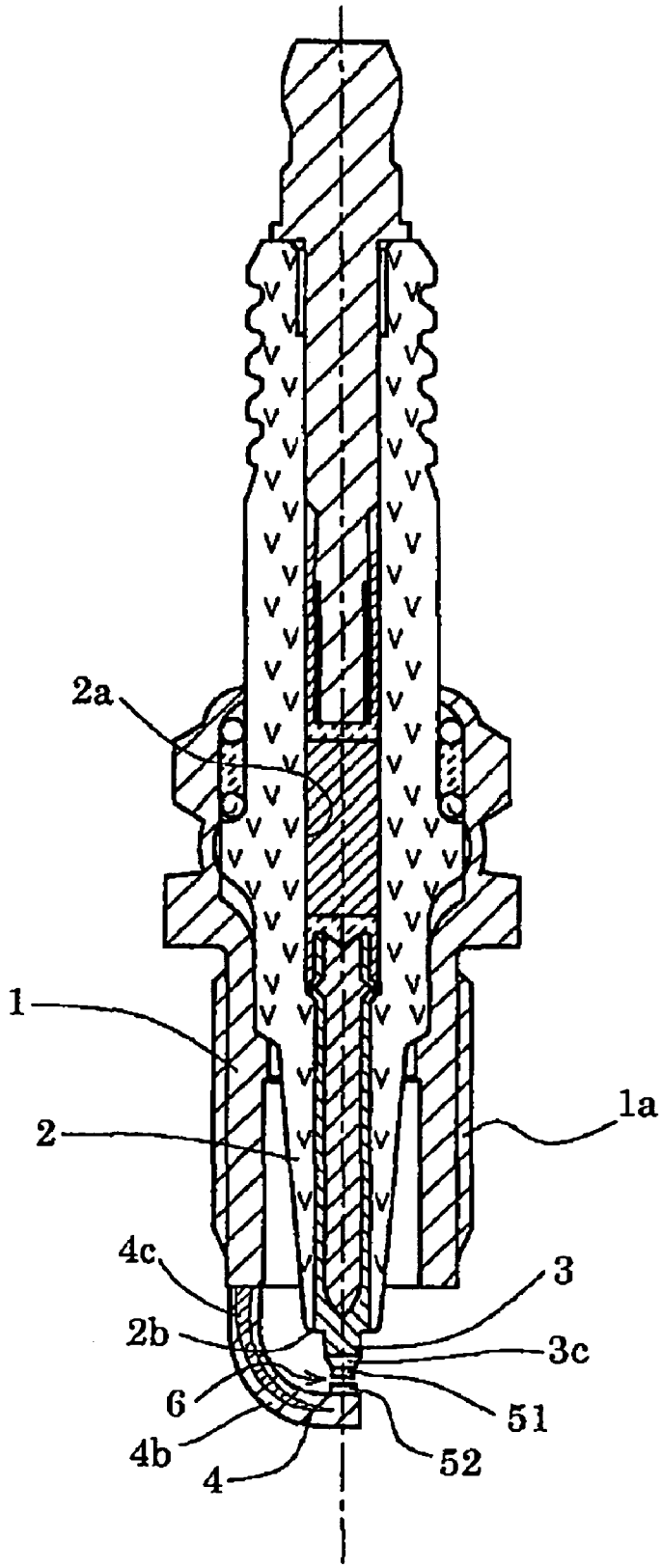
FIG. 1 is a front view showing an embodiment of a spark plug according to the present invention.

Reference numerals used to identify various structural elements in the drawings include the following:

1: metallic shell
1*a*: male-threaded portion
2: insulator
3: center electrode
4: ground electrode
4*a*: electrode base metal surface
4*b*: electrode base metal
4*c*: high-heat-conduction material
51: distal end portion of center electrode 3
51*a*: distal end surface of distal end portion 51
51*b*: noble metal tip
52: discharge portion
52*a*: distal end surface of discharge portion 52
52*b*: noble metal tip
6: discharge gap
ϕA: diameter of distal end portion of center electrode
ϕB: diameter of discharge portion of ground electrode
C: length of projection of discharge portion of the ground electrode from the electrode base metal surface

DESCRIPTION OF THE PREFERRED EMBODIMENTS

A spark plug according to a preferred embodiment of the present invention will next be described in detail. However, the present invention should not be construed as being limited thereto.

FIG. 1 shows the spark plug of the present embodiment. As shown in FIG. 1, the spark plug includes a metallic shell 1 assuming a cylindrical shape. The metallic shell 1 has a male-threaded portion 1*a* for fixing the spark plug to an unillustrated engine block. An insulator 2 formed of alumina ceramic ($Al_2O_3$) or the like is fixed in the metallic shell 1. A center electrode 3 is fixed in an axial hole 2*a* formed in the insulator 2. A distal end portion 2*b* of the insulator 2 projects from the metallic shell 1.

The center electrode 3 is a cylindrical solid configured as follows: a metal material having high thermal conductivity, such as Cu, serves as a core and is covered with a metal material having high resistance to heat and corrosion, such as INCONEL 600 (trade name of a nickel-base alloy). A distal end portion 51 of the center electrode 3 projects from the distal end portion 2*b* of the insulator 2. The distal end portion 51 is formed of a noble metal tip 51*b*, which assumes a circular cross section and is made of an iridium alloy.

A distal end section of the center electrode 3 is formed into a small-diameter portion 3*c*, and a straight portion, which extends toward the distal end of the center electrode 3 from the small-diameter portion 3*c*. The noble metal tip 51*b* is placed on and laser-welded to the distal end of the straight portion, thereby forming the distal end portion 51. The diameter of the straight portion is slightly greater than that of the noble metal tip 51*b*. The noble metal tip 51*b* is laser-welded at 8 spots arranged on its circumferential portion at 45° circumferential intervals. The noble metal tip 51*b* is made of a noble metal alloy that contains a predominant amount of iridium; for example, a 95% by mass iridium-5% by mass platinum alloy, an 80% by mass iridium-20% by mass rhodium alloy, or a 95% by mass iridium-5% by mass yttria alloy. Notably, herein, the expression "predominant amount of a substance" means that the substance content is in excess of 50% by mass.

A ground electrode 4 is welded to one end of the metallic shell 1. The ground electrode 4 is formed of a metal material, such as INCONEL 600 (trade name of a nickel-base alloy). A material 4*c*, such as copper or pure nickel, whose thermal conductivity is higher than that of an electrode base metal 4*b* of the ground electrode 4 is embedded in the electrode base metal 4*b*. A noble metal tip 52*b*, which contains a predominant amount of a noble metal, is laser-welded to an electrode base metal surface 4*a* of the ground electrode 4 so as to project from the electrode base metal surface 4*a*, thereby forming a discharge portion 52 of the ground electrode 4. A distal end surface 52*a* of the discharge portion 52 and a distal end surface 51*a* of the distal end portion 51 of the center electrode 3 form a discharge gap 6. Generally, the width of the ground electrode 4 is 2.2 mm to 2.8 mm. The discharge portion 52 assumes a circular cross section and is made of a noble metal alloy that contains a predominant amount of platinum or iridium; for example, an 80% by mass platinum-20% by mass iridium alloy, an 80% by mass platinum-20% by mass rhodium alloy, or an 80% by mass platinum-20% by mass nickel alloy.

In the case where high ignition performance must be maintained over the entire service life of the spark plug, a noble metal alloy use as discharge portion 52 must exhibit a survival rate of 90% or higher as measured after being subjected for 100 hours in the atmosphere (air atmosphere) to a temperature of 1,000° C. in an electric furnace. In many cases, such a noble metal alloy contains a predominant amount of platinum. However, if the requirement for survival rate is satisfied, even an alloy that contains a predominant amount of iridium can be used. Generally, consumption of the distal end portion 51 of the center electrode 3 caused by spark discharge is greater than that of the discharge portion 52 of the ground electrode 4. The temperature of the discharge portion 52 of the ground electrode 4 tends to become higher than that of the distal end portion 51 of the center electrode 3. In order to satisfy the survival rate of 90% or higher as defined above, use of either of the following alloys is recommended for the discharge portion in this embodiment: a platinum alloy containing 20% by mass (or rather by weight) or less of iridium and 10% by mass or less of nickel, in which a total of iridium and nickel does not exceed 20% by mass; a platinum alloy containing rhodium and 10% by mass or less of nickel; or an alloy containing platinum, iridium, rhodium and 10% by mass or less of nickel, in which a weight ratio of rhodium to iridium is 20% or more.

EXAMPLES

In order to verify the effect of the above-described preferred embodiment of the present invention, the experiments described below were carried out. First, iridium and rhodium in respectively predetermined amounts were mixed and melted, thereby forming an 80% by mass iridium-20% by mass rhodium alloy. The alloy was subjected to predetermined working steps, thereby yielding the noble metal tips 51*b* for application to the center electrode 3, each tip 51*b* having a diameter (ϕA) of 0.3 mm and a length of 0.8 mm. Similarly, platinum and rhodium in respectively predetermined amounts were mixed and melted, thereby forming an 80% by mass platinum-20% by mass rhodium alloy. The alloy was subjected to predetermined working steps, thereby yielding noble metal tips 52*b* of various diameters and lengths for application to the ground electrode 4.

Figure 2:
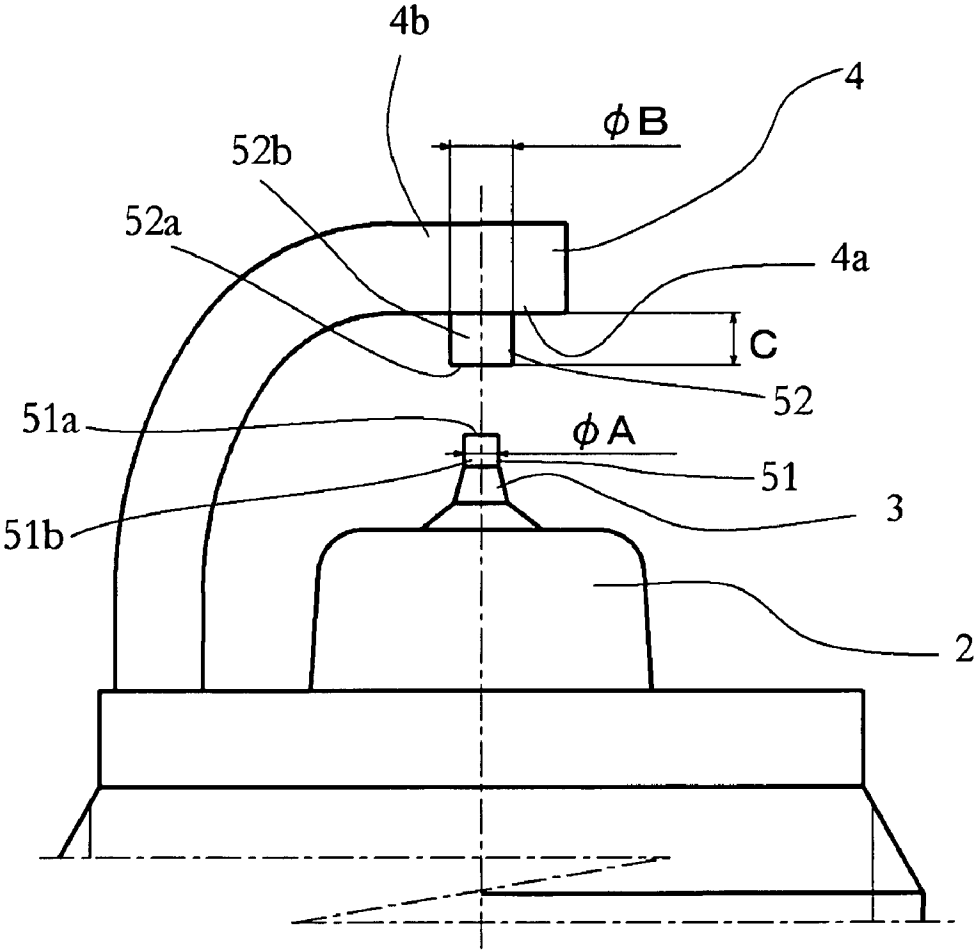
FIG. 2 is an enlarged view showing essential portions of the spark plug of FIG. 1.
Figure 3:
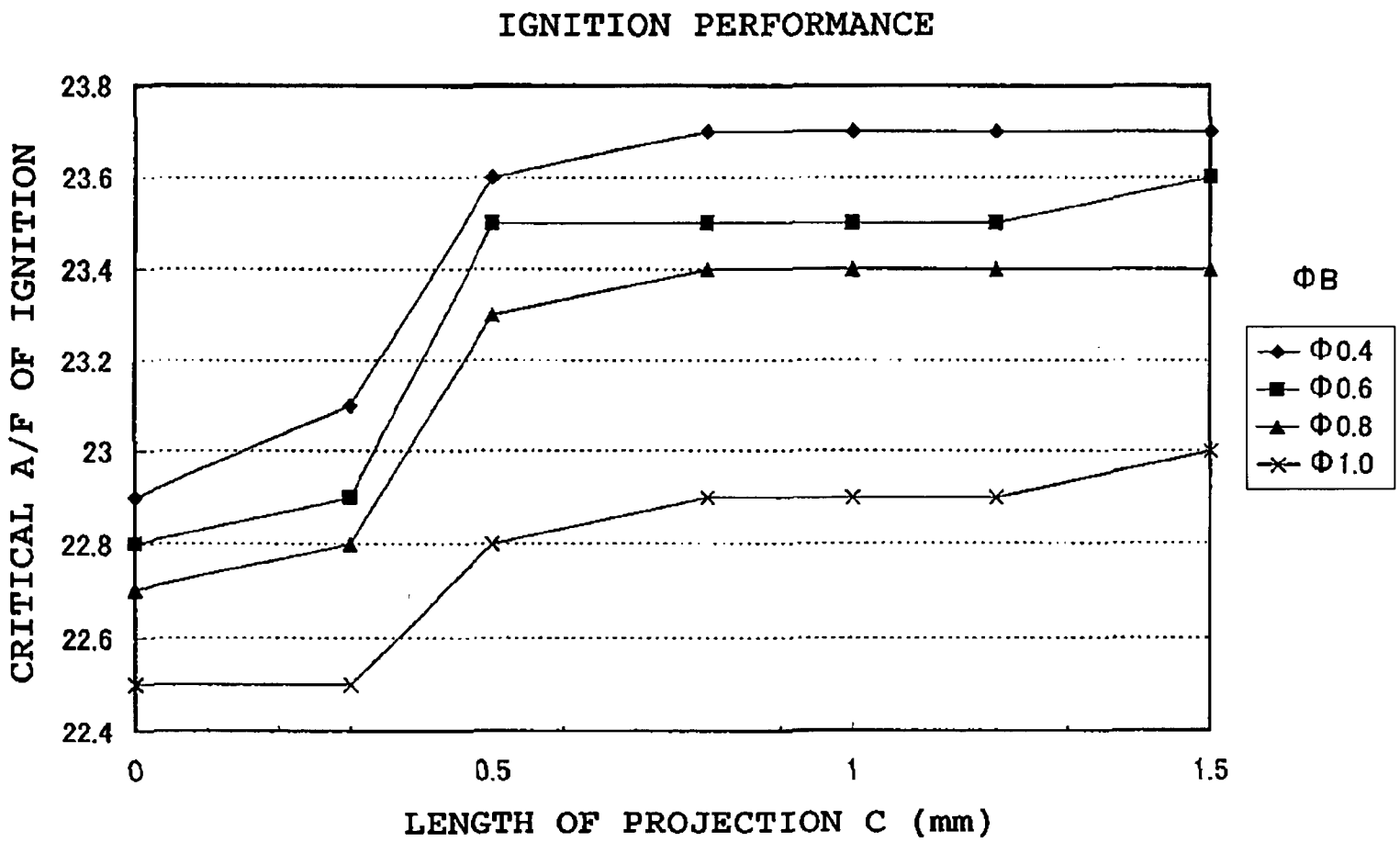
FIG. 3 is a graph showing the results of an ignition performance test.

The thus-obtained noble metal tips were used to form the distal end portions 51 and the discharge portions 52 of spark plug samples to be tested. The discharge gap 6 between the distal end portion 51 and the discharge portion 52 was set to 0.8 mm. In manufacture of the spark plug samples, the diameter ϕB and the projection length C of the discharge portion 52 shown in FIG. 2 were varied as shown in FIG. 3, which will be described below. The spark plug samples were tested for ignition performance as follows. The ignition performance test was conducted by a load-load lean burn method. The test employed a straight, 6-cylinder, 2-liter, DOHC engine whose air-fuel ratio (A/F) was variable. The test conditions corresponded to cruising at 60 km/h and 2,000 rpm. The test was conducted at various values of A/F. When the combustion pressure dropped to 50% or less of the indicated mean effective pressure (IMEP) of 1,000 cycles, misfire was considered to occur at the tested A/F. When misfire occurred 10 times at a certain A/F, the A/F was defined as the critical A/F of ignition. The test results are shown in FIG. 3.

As shown in FIG. 3, when the diameter ϕB of the discharge portion 52 is 1.0 mm, the critical A/F of ignition is far lower than in the case of other diameter ϕB values. Also, at a projection length C of 0.5 mm or more, the critical A/F of ignition is far improved as compared with the case of a projection length C of less than 0.5 mm. In other words, by setting the diameter ϕB of the discharge portion 52 to 0.8 mm or less and the projection length C to 0.5 mm or more, the critical A/F of ignition is greatly improved.

Next, a high-temperature oxidation resistance test was conducted. The noble metal tips 51*b* and 52*b* were manufactured as mentioned above. The diameter ϕA of the noble metal tip 51*b* of the center electrode was set to 0.5 mm. The high-temperature oxidation resistance test was conducted on spark plug samples in which the noble metal tip 52*b* of the ground electrode 4 was made of a noble metal alloy that contained an 80% by mass of platinum and 20% by mass of nickel.

The high-temperature oxidation resistance test employed a straight, 6-cylinder, 2-liter, DOHC engine and was conducted under the following conditions: 4,900 rpm, wide open throttle, and 250 hours. The test conditions were determined so as to bring the temperature of the base metal of the ground electrode 4 to about 1,000° C. After the test, the spark plug samples were measured for an increase in the discharge gap 6. The test results are shown in FIG. 4.

Figure 4:
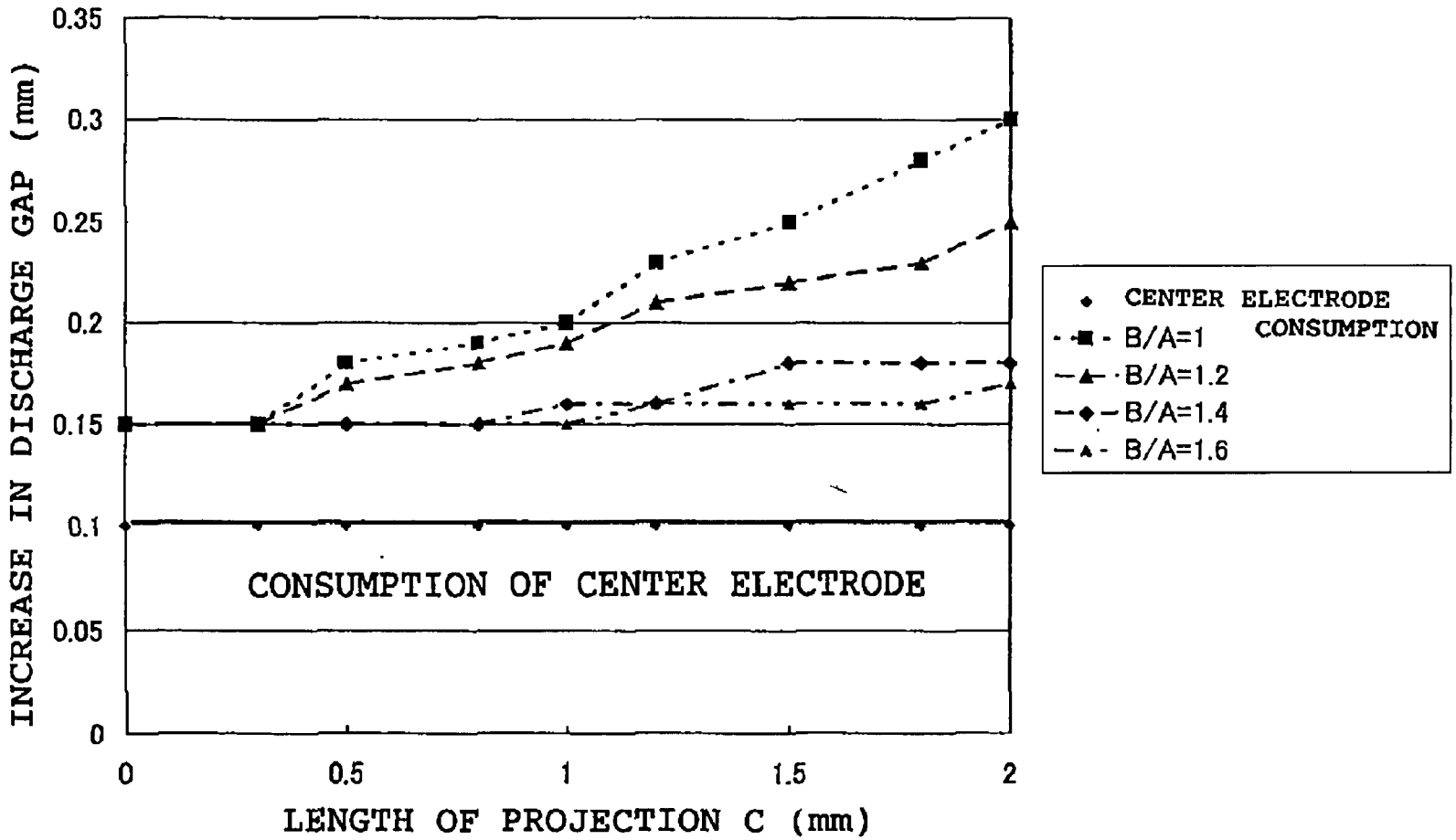
FIG. 4 is a graph showing the results of a high-temperature oxidation resistance test in the case where an iridium alloy is used to form a noble metal tip of a ground electrode.

As shown in FIG. 4, when the ratio of the diameter ϕB of the discharge portion 52 to the diameter A of the distal end portion 51, or B/A, is 1.0 or 1.2, the discharge gap exhibits a large increase as compared with the case of other B/A ratios. Also, when the projection length C is greater than 1.5 mm, the discharge gap 6 increases to a greater extent. In other words, by setting B/A to 1.4 or more and the projection length C to 1.2 mm or less, high-temperature oxidation resistance is greatly improved.

Next, the above-mentioned high-temperature oxidation resistance test was conducted on spark plug samples in which the noble metal tip 52*b* of the ground electrode 4 was made of a noble metal alloy that contained a predominant amount of platinum; specifically, of an 80% by mass platinum-20% by mass rhodium alloy. The test results are shown in FIG. 5.

Figure 5:
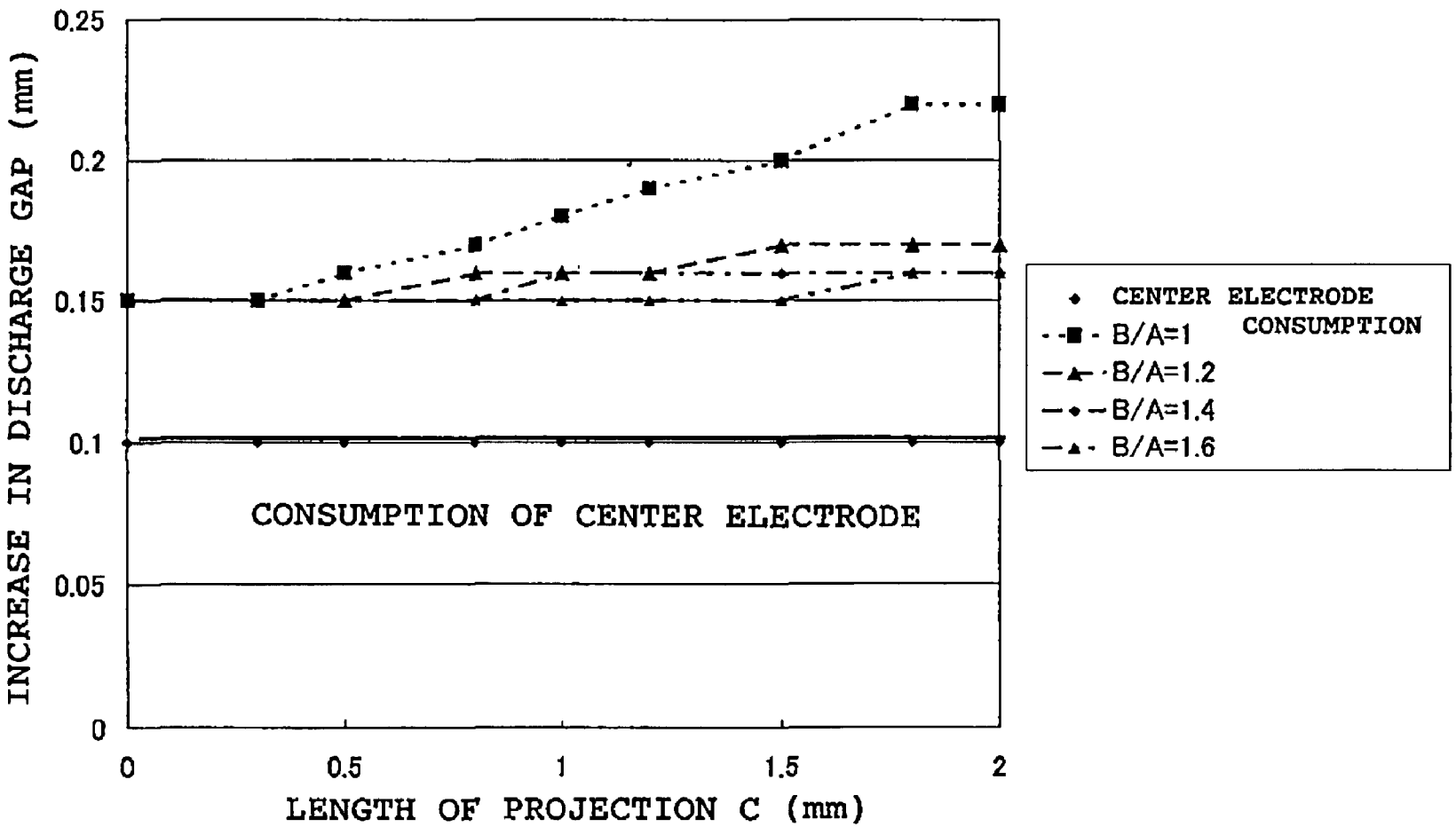
FIG. 5 is a graph showing the results of a high-temperature oxidation resistance test in the case where a platinum alloy having a survival rate of 90% or higher is used to form a noble metal tip of a ground electrode.

As shown in FIG. 5, when the ratio of the diameter ϕB of the discharge portion 52 to the diameter ϕA of the distal end portion 51, or B/A, is 1.0, the discharge gap exhibits a large increase as compared with the case of other B/A ratios. Also, when the length projection C is greater than 1.5 mm, the discharge gap 6 increases to a greater extent. In other words, by setting B/A to 1.2 or more and the projection length C to 1.2 mm or less, high-temperature oxidation resistance is greatly improved.

Furthermore, various noble metal alloys that contained a predominant amount of iridium, and various noble metal alloys that contained a predominant amount of platinum, were tested for their high-temperature oxidation characteristic. In contrast to the above-described tests, the present test was not conducted with respect to spark plugs. The weight of tips of the noble metal alloys was measured before and after being subjected for 100 hours in an air atmosphere to a temperature of 1,000° C. in an electric furnace, whereby their survival rates (remaining mass %) were calculated. The test results are shown in FIG. 6.

Figure 6:
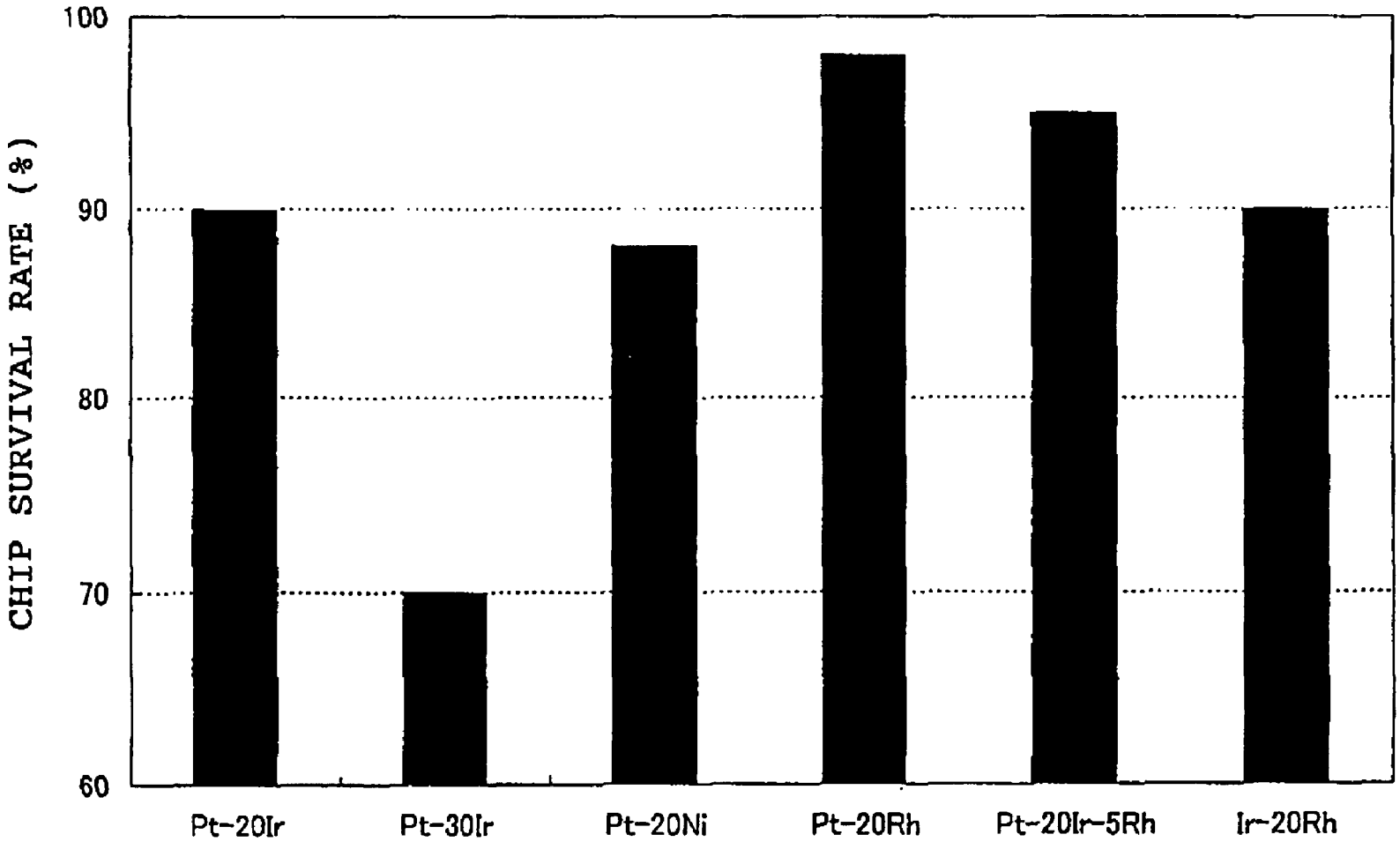
FIG. 6 is a graph showing the results of a high-temperature oxidation characteristic test conducted on noble metal tips.

As shown in FIG. 6, because iridium exhibits high oxidational volatilization, adding iridium in an amount of more than 20% by mass to platinum that hardly exhibits oxidational volatilization, causes the survival rate to decrease below 90%. Notably, the oxidational volatilization is a phenomenon in which a metal is oxidized and volatilized. However, as is also apparent from FIG. 6, even when the iridium content is 20% by mass or higher, addition of rhodium can suppress oxidational volatilization. This is conceivably because rhodium forms an oxide film to thereby suppress oxidational volatilization of iridium. Thus, even in the case of a noble metal alloy that contains a predominant amount of platinum, its survival rate becomes lower than 90% depending on the species and amount of a metal to be added. Similarly, even in the case of a noble metal alloy that contains a predominant amount of iridium, its survival rate becomes higher than 90% depending on the species and amount of a metal to be added.

The above test results reveal that when the diameter ϕB of the distal end portion 51, the diameter ϕA of the discharge portion 52, and the length of projection C of the discharge portion 52 from the base metal surface 4*a* satisfy $\phi B \leqq 0.8$ mm, $\phi B/\phi A \geqq 1.4$, and $0.5\ \text{mm} \leqq C \leqq 1.2$ mm, ignition performance and durability can be maintained over a long period of time.

The above test results also reveal that when the noble metal tip 51*b* of the ground electrode 4 exhibits a survival rate of 90% or higher as measured after being subjected for 100 hours in an air atmosphere to a temperature of 1,000° C. in an electric furnace; for example, when the noble metal tip 51*b* is of an 80% by mass platinum-20% by mass rhodium alloy, a 75% by mass platinum-20% by mass iridium-5% by mass rhodium alloy, or an 80% by mass iridium-20% by mass rhodium, even in the case of $\phi B/\phi A \geqq 1.2$, ignition performance and durability can be maintained over a long period of time.

It should further be apparent to those skilled in the art that various changes in form and detail of the invention as shown and described above may be made. It is intended that such changes be included within the spirit and scope of the claims appended hereto.

This application is based on Japanese Patent Application No. 2003-373435 filed Sep. 27, 2003, incorporated by reference herein in its entirety.

What is claimed is:

1. A spark plug comprising:

a center electrode (3);

an insulator (2) surrounding the center electrode (3) such that a distal end portion (51) disposed on the center electrode (3) projects from the insulator (2);

a metallic shell (1) holding the insulator (2); and a ground electrode (4) comprising a base metal (4*b*) fixed to the metallic shell (1) and having a discharge portion (52) projecting from and laser-welded to an electrode base metal surface (4*a*) of the ground electrode (4), a discharge gap (6) being formed between a distal end surface (52*a*) of the discharge portion (52) and a distal end surface (51*a*) of the distal end portion (51) of the center electrode (3); and the spark plug satisfying $$0.36\ \text{mm} \leqq \phi B \leqq 0.8\ \text{mm},$$

$$\phi B/\phi A \geqq 1.2, \text{ and}$$

$$0.5\ \text{mm} \leqq C \leqq 1.2\ \text{mm},$$

where $\phi A$ (mm) is a diameter of the distal end portion (51) formed of a noble metal tip (51*b*), which contains a predominant amount of a noble metal; $\phi B$ (mm) is a diameter of the discharge portion (52) formed of a noble metal tip (52*b*), which contains a predominant amount of a noble metal and having a survival rate of 90% or higher after being subjected for 100 hours in an air atmosphere to a temperature of 1,000° C. in an electric furnace; and C (mm) is a projection length of the discharge portion (52) from the electrode base metal surface (4*a*).

2. The spark plug as claimed in claim 1, further comprising a core material (4*c*) embedded in the base metal (4*b*) of the around electrode (4), the core material (4*c*) having a thermal conductivity higher than that of electrode base metal (4*b*).

3. The spark plug as claimed in claim 1, the discharge portion (52) is made of one of the following alloys: a platinum alloy containing 20% by mass or less of iridium and 10% by mass or less of nickel, in which a total amount of iridium and nickel does not exceed 20% by mass; a platinum alloy containing rhodium and 10% by mass or less of nickel; or an alloy containing platinum, iridium, rhodium and 10% by mass or less of nickel, in which a weight ratio of rhodium to iridium is 20% or more.

4. The spark plug as claimed in claim 1, the spark plug satisfying $$\phi B/\phi A \geqq 1.4.$$

5. The spark plug as claimed in claim 1, wherein the discharge portion (52) projecting from and laser-welded to an electrode base metal surface (4*a*) of the ground electrode (4) is formed of a noble metal tip (52*b*) which contains a predominant amount of iridium.

6. The spark plug as claimed in claim 1, wherein the discharge portion (52) projecting from and laser-welded to an electrode base metal surface (4*a*) of the ground electrode (4) is formed of a noble metal tip (52*b*) which contains a predominant amount of Pt and additionally Ir and Rh.

7. The spark plug as claimed in claim 1, wherein the discharge portion (52) projecting from and laser-welded to an electrode base metal surface (4*a*) of the ground electrode (4) is formed of a noble metal tip (52*b*) made of a Pt-20 wt % Rh alloy.

* * * * *